US006494994B1

(12) United States Patent
Aikawa

(10) Patent No.: US 6,494,994 B1
(45) Date of Patent: Dec. 17, 2002

(54) PULP HEATING APPARATUS

(75) Inventor: Yoshihiko Aikawa, Shizuoka (JP)

(73) Assignee: Aikawa Iron Works Co., Ltd., Shizuoka (JP)

( * ) Notice: Subject to any disclaimer, the term of this patent is extended or adjusted under 35 U.S.C. 154(b) by 0 days.

(21) Appl. No.: 10/078,504

(22) Filed: Feb. 21, 2002

(30) Foreign Application Priority Data

Oct. 17, 2001 (JP) ..... 2001-319454

(51) Int. Cl.[7] ..... D21C 9/00; D21C 9/18; B07B 9/00

(52) U.S. Cl. ..... 162/261; 762/250; 241/38; 432/121; 432/239; 34/114

(58) Field of Search ..... 162/261, 250, 162/56, 63, 68; 241/38, 244–247, 296; 432/98, 100, 121, 234; 34/114, 122, 609–610; 209/273, 3, 164, 169, 168, 5, 11, 117; 210/705

(56) References Cited

U.S. PATENT DOCUMENTS 4,037,792 A * 7/1977 Peterson ..... 162/17
4,249,703 A * 2/1981 Korenev et al. ..... 241/247
4,326,913 A * 4/1982 Mattsson ..... 162/17
4,909,900 A * 3/1990 Matzke et al. ..... 162/26
4,997,578 A * 3/1991 Berggren ..... 100/117
5,145,072 A * 9/1992 Hautala ..... 162/261
5,176,793 A 1/1993 Kurtz
5,198,075 A * 3/1993 Nivelleau de La Bruniere et al. ..... 162/19
5,465,915 A * 11/1995 Ahlen et al. ..... 162/261
5,958,179 A * 9/1999 Gehr et al. ..... 162/56
6,419,786 B1 * 7/2002 Kurtz ..... 162/18
2001/0050151 A1 * 12/2001 Sabourin ..... 162/19

* cited by examiner

*Primary Examiner*—Jose A. Fortuna
(74) *Attorney, Agent, or Firm*—Kanesaka & Takeuchi

(57) ABSTRACT

A pulp heating apparatus has a heater main body 1 which has a pulp introduction port for introducing pulp, a vapor introduction port for introducing vapor, a disperser for dispersing the pulp introduced via the pulp introduction port under a high temperature and a pulp exhaust port for exhausting the pulp dispersed by the disperser and is arranged in a horizontal direction. The disperser has a spiral vane section which continues spirally around a rotational shaft and discontinuous vane sections around the rotational shaft. The pulp introduction port is provided at a bottom section of the heater main body and is connected to an introduction passage. A screw conveyor is provided on the introduction passage. A forward end of the introduction passage faces towards the spiral vane section.

2 Claims, 5 Drawing Sheets

PULP HEATING APPARATUS

BACKGROUND OF THE INVENTION

1. Field of the Invention

The present invention relates to a pulp heating apparatus and particularly relates to a pulp heating apparatus in which an arrangement of components is improved.

2. Description of the Related Art

For example, Japanese Patent No. 2811489 (U.S. Pat. No.5,176,793) discloses a processing apparatus for heating pulp.

In this processing apparatus, as shown in FIG. 1 of Japanese Patent No. 2811489 (U.S. Pat. No. 5,176,793), a vertical conveyor screw (6) is provided between a plug screw (5) and a pulp shredder (7), and pulp carried by the plug screw (5) is led to the pulp shredder (7) positioned in a heating section by the vertical conveyor screw (6).

In this processing apparatus, in the case where the pulp is led to the pulp shredder (7), if the vertical conveyor screw (6) does not exist, a block of the pulp exhausted by the plug screw (5) drops towards the pulp shredder (7) due to gravity because the pulp shredder (7) is positioned below the plug screw (5). Thereafter, the block is supplied to the pulp shredder (7) and the shredding of the pulp is occasionally interfered, namely, the pulp is not shredded sufficiently.

In order to prevent the above case, there arises a problem that the vertical conveyor screw (6) is required as a pulp breaking machine between the plug screw (5) and the

SUMMARY OF THE INVENTION

It is an object of the present invention to provide a pulp heating apparatus which removes the above problem.

In order to achieve the above object, a pulp heating apparatus of a first aspect is constituted so as to include a heater main body having a pulp introduction port for introducing pulp, a vapor introduction port for introducing vapor, a disperser for dispersing the pulp introduced via the pulp introduction port under a high temperature and a pulp exhaust port for exhausting the pulp dispersed by the disperser, and the heater main body being arranged in horizontal is direction, and so that the disperser has a spiral vane section which continues spirally around a rotational shaft and discontinuous vane sections around the rotational shaft, the pulp introduction port is provided at a bottom section of said heater main body and is connected with an introduction passage and a screw conveyor is provided on the introduction passage and a forward end of the introduction passage faces towards the spiral vane section.

In addition, a pulp heating apparatus of a second aspect is constituted so as to include: a heater main body having a pulp introduction port for introducing pulp, a vapor introduction port for introducing vapor, a disperser for dispersing the pulp introduced via the pulp introduction port under a high temperature and a pulp exhaust port for exhausting the pulp dispersed by the disperser, and the heater main body being arranged in horizontal direction, and so that the disperser has a spiral vane section which continues spirally around a rotational shaft and discontinuous vane sections around the rotational shaft, the pulp introduction port is provided at a bottom section of said heater main body and is connected with an introduction passage and a screw conveyor is provided on the introduction passage, a forward end of the introduction passage faces towards the spiral vane section and convex sections are provided on an outer periphery of the spiral vane section facing towards the forward end of the introduction passage.

DETAILED DESCRIPTION OF PREFERRED EMBODIMENTS

There will be explained below a pulp heating apparatus according to one embodiment of the present invention with reference to the drawings.

Figure 1:
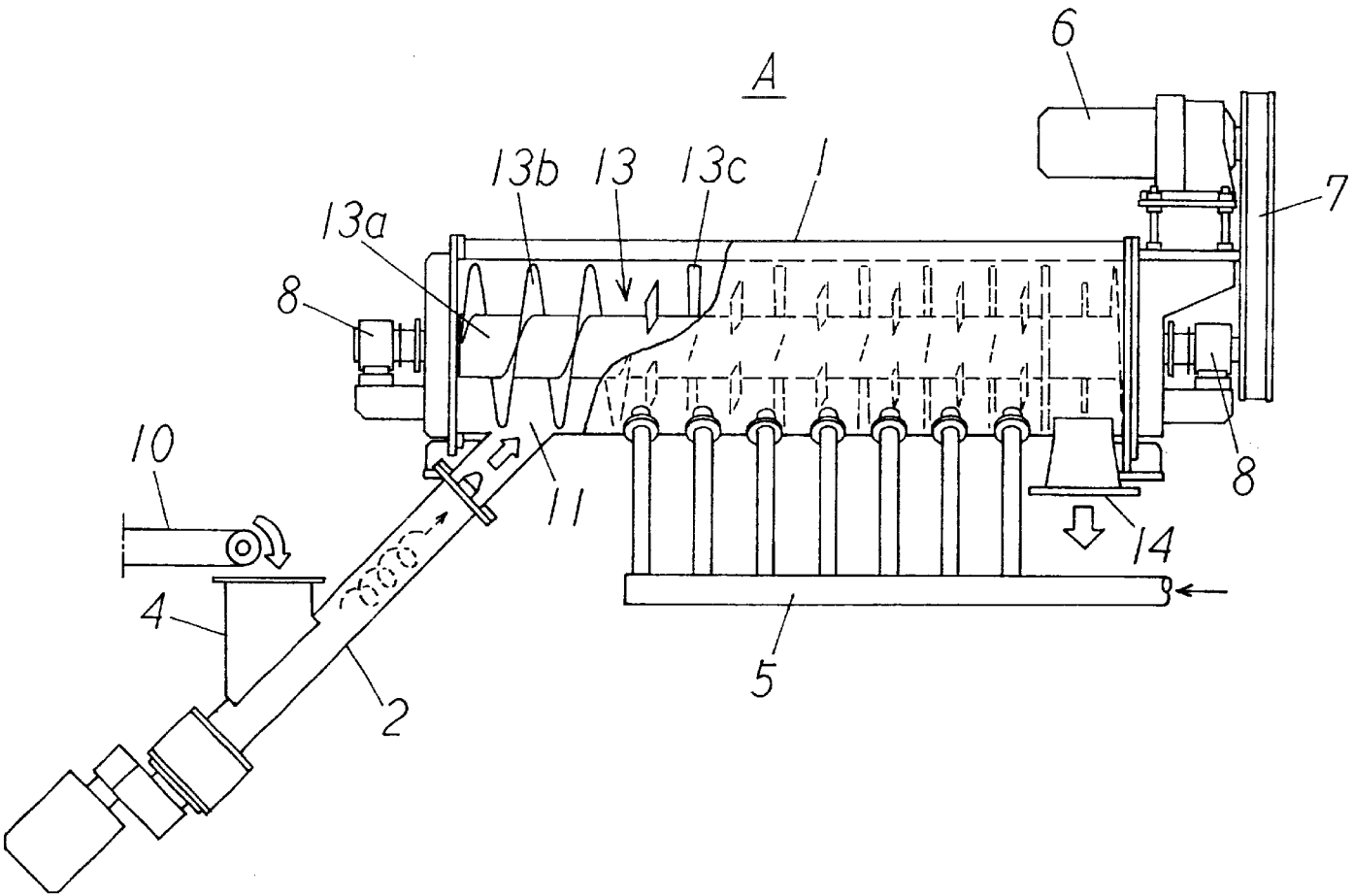
FIG. 1 is a schematic cross sectional view showing a pulp heating apparatus according to one embodiment of the present invention.
Figure 2:
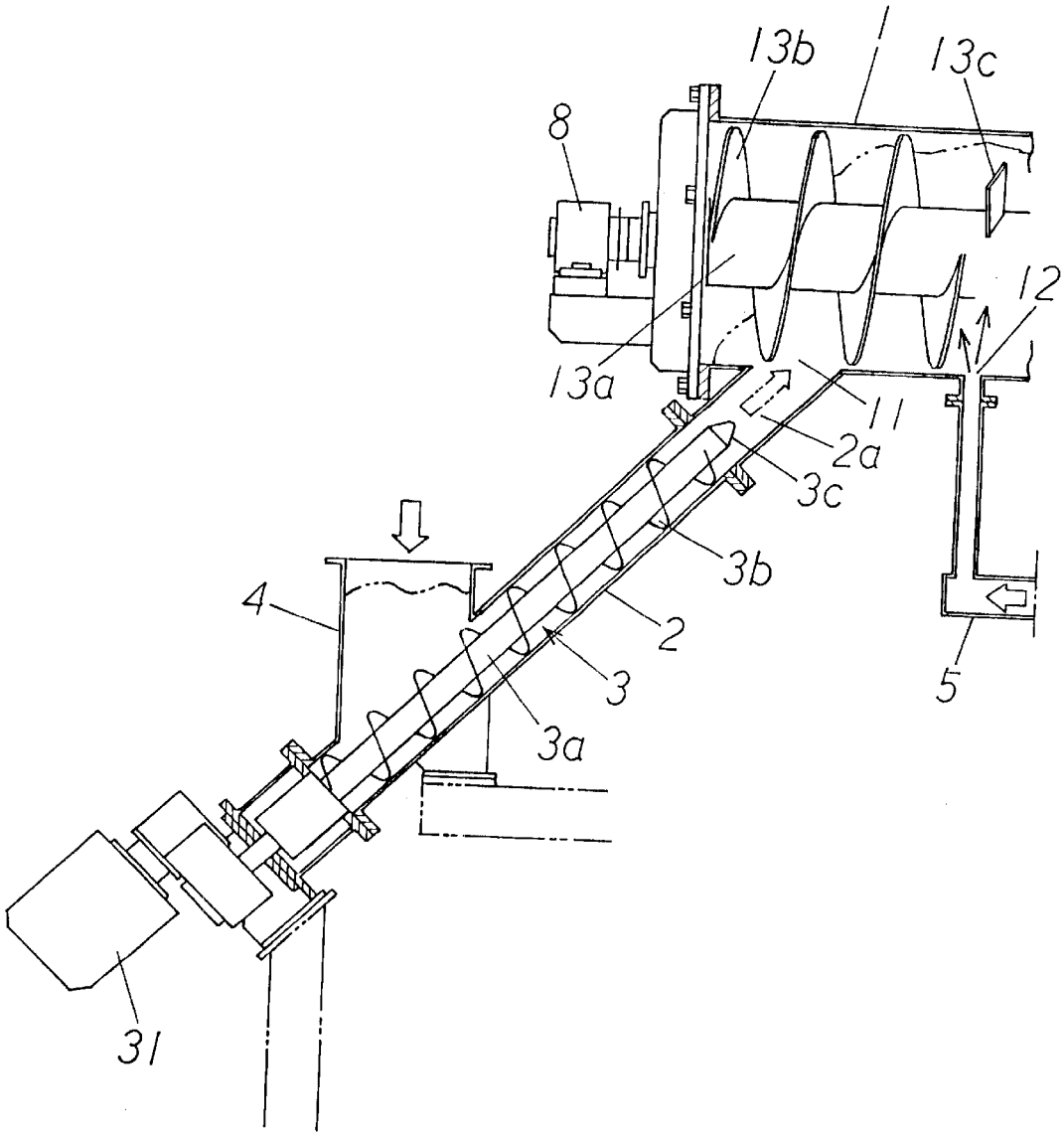
FIG. 2 is a schematic partially enlarged cross sectional view showing an enlarged portion of a pulp introduction port shown in FIG. 1.
Figure 3:
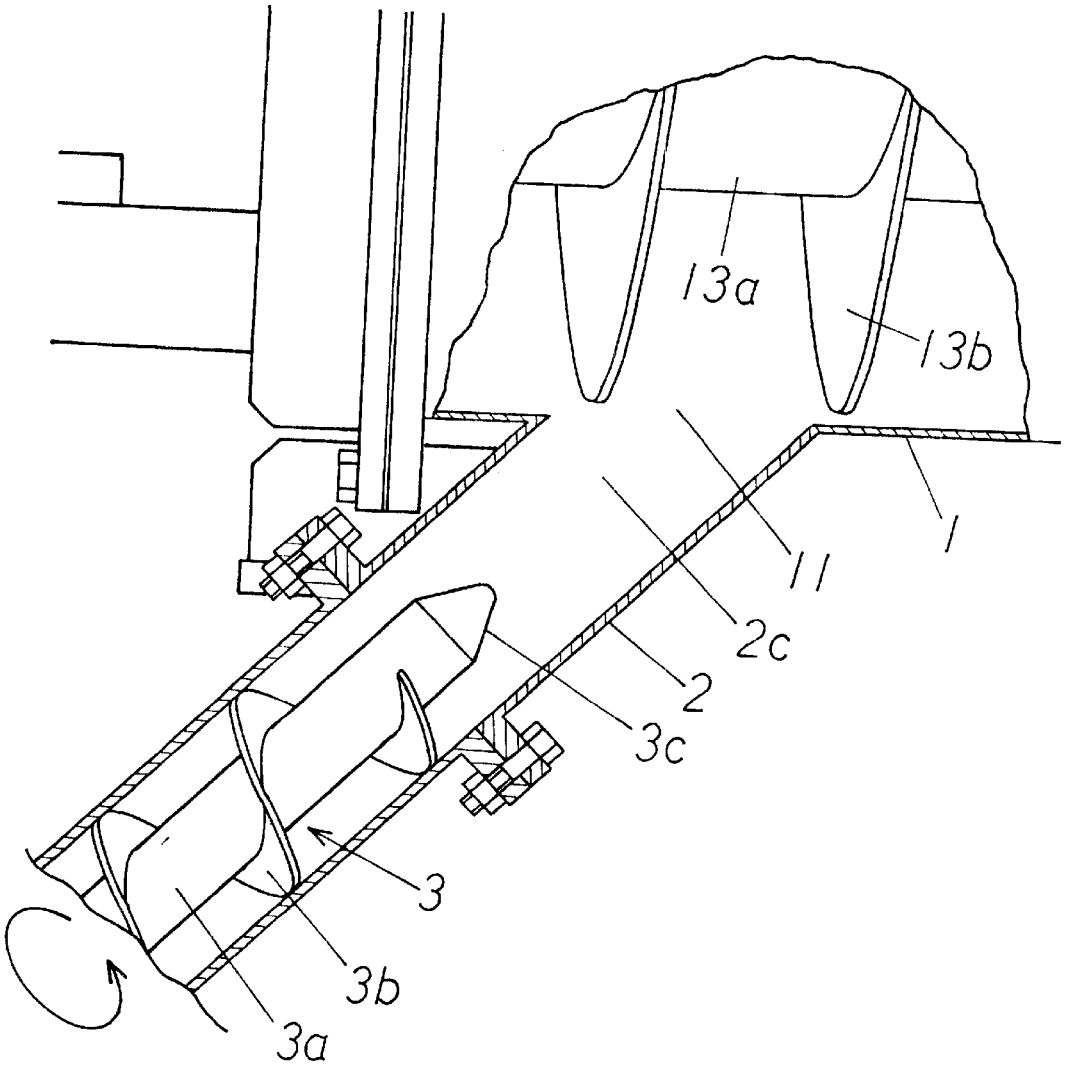
FIG. 3 is a schematic partially enlarged cross sectional view showing an enlarged portion of FIG. 2.

In FIGS. 1 through 3, A denotes a pulp heating apparatus. The pulp heating apparatus A has a heater main body 1 which is arranged in a horizontal direction. The heater main body has a pulp introduction port 11 for introducing pulp, a vapor introduction port 12 for introducing vapor, a disperser 13 for dispersing the pulp introduced via the pulp introduction port 11 under high temperature, and a pulp exhaust port 14 for exhausting the pulp dispersed by the disperser 13. 6 denotes a motor for rotating the disperser 13 via a belt 7, and 8 denotes a bearing for supporting a rotational shaft 13*a* of the disperser 13.

The disperser 13 is provided with a vane around the rotational shaft 13*a*, and more specifically the vane has a spiral vane section 13*b* which continues spirally and discontinuous vane sections 13*c* around the rotational shaft 13*a*. The vane sections 13*c* are positioned on a lower stream side of a pulp stream below the spiral vane section 13*b*.

The pulp introduction port 11 is provided at a bottom section of the heater main body 1 and is connected to an introduction passage 2. On the introduction passage 2, a screw conveyor 3 is arranged, and the screw conveyor (plug screw) 3 has a spiral vane section 3*b*, which continues spirally around a rotational shaft 3*a* and is not provided at the forward end of the rotational shaft 3*a*, and a taper section 3*d* which becomes narrower towards the pulp introduction port 11.

In addition, a pulp reservoir section 2*a* is formed at the forward end of the rotational shaft 3*a*, namely, between the taper section 3*d* and the pulp introduction port 11. The forward end of the introduction passage 2 faces towards the spiral vane section 3*b*.

31 denotes a motor for rotating the rotational shaft 3*a* of the screw conveyor (plug screw) 3.

Further, 4 denotes a supply passage for supplying the pulp dewatered by a screw press, not shown, to the introduction passage 2, and 5 denotes a vapor introduction passage which is connected to the vapor introduction port 12 and leads vapor into the heater main body 1.

Therefore, when the pulp dewatered by the screw press, not shown, is supplied via the supply passage 4 to the introduction passage 2, the pulp is conveyed to the pulp introduction port 11 by the screw conveyor 3.

Since the pulp introduction port 11 is provided at the bottom section of the heater main body 1, the pulp is reserved in the pulp reservoir section 2*a* and one end of the heater main body 1 is sealed. The other end of the heater main body 1 is sealed by sealing means, not shown, at a lower stream side of the pulp stream of the pulp exhaust port 14, and the heater main body 1 is maintained in a state that a vapor temperature is heightened.

Particularly when the pulp is supplied to the heater main body 1 by the screw conveyor 3, since the forward end of the introduction passage 2 provided with the screw conveyor 3 therein faces towards the spiral vane section 13*b*, the pulp can be broken by the spiral vane section 13*b*.

As a result, a pulp breaking machine which is conventionally provided between a screw conveyor and a disperser [for example, a vertical conveyor screw (6) disclosed in Japanese Patent No. 2811489 (U.S. Pat. No. 5,176,793)] is not required.

The pulp which is introduced via the pulp introduction port 11 into the heater main body 1 and in the state of high vapor temperature (for example, about 120° C.) is supplied into the heater main body 1 and is broken by the spiral vane section 13*b* and the vane sections 13*c*, and is led from the pulp exhaust port 14 to a machine for another step (not shown).

The pulp of the present embodiment is suitable particularly to the case where pigment in ink in wastepaper is dissociated.

In addition, in the above-mentioned embodiment, the forward end of the introduction passage 2 simply faces towards the spiral vane section 13*b*. However, as shown in FIGS. 4 through 7, convex sections $T_1$, $T_2$ are provided on an outer periphery of the spiral vane section 13*b* facing towards the forward end of the introduction passage 2 so that solid pulp (raw material) which is exhausted from the screw conveyor (plug screw) 3 can be further broken by the convex sections $T_1$, $T_2$.

Figure 4:
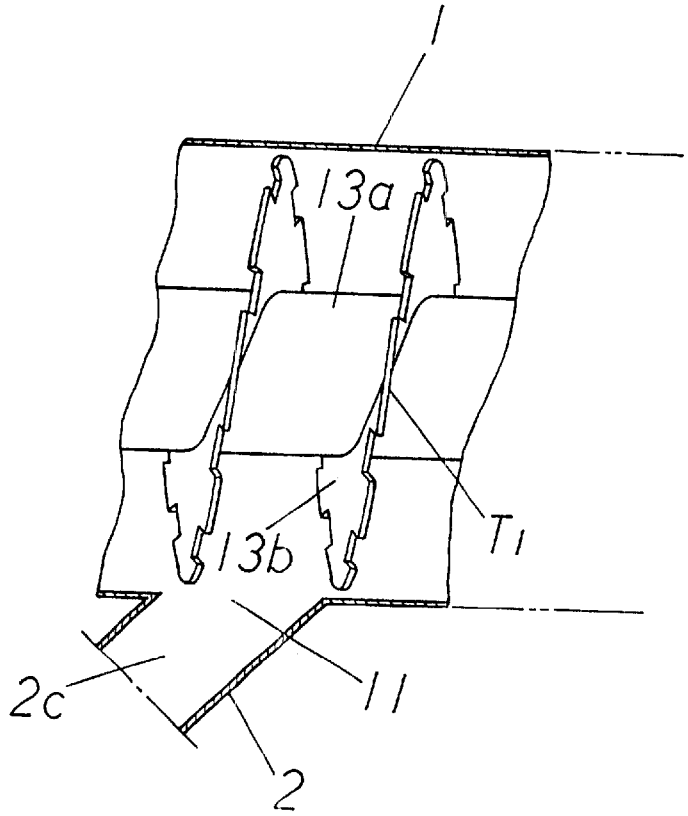
FIG. 4 is a schematic cross sectional view showing the pulp introduction port according to another embodiment of the present invention.
Figure 5:
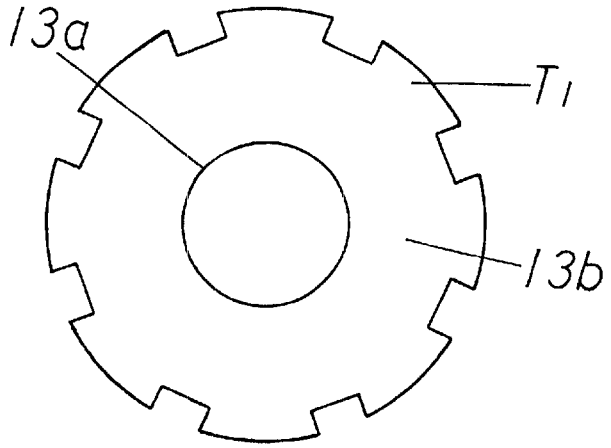
FIG. 5 is a schematic side view of FIG. 4.
Figure 6:
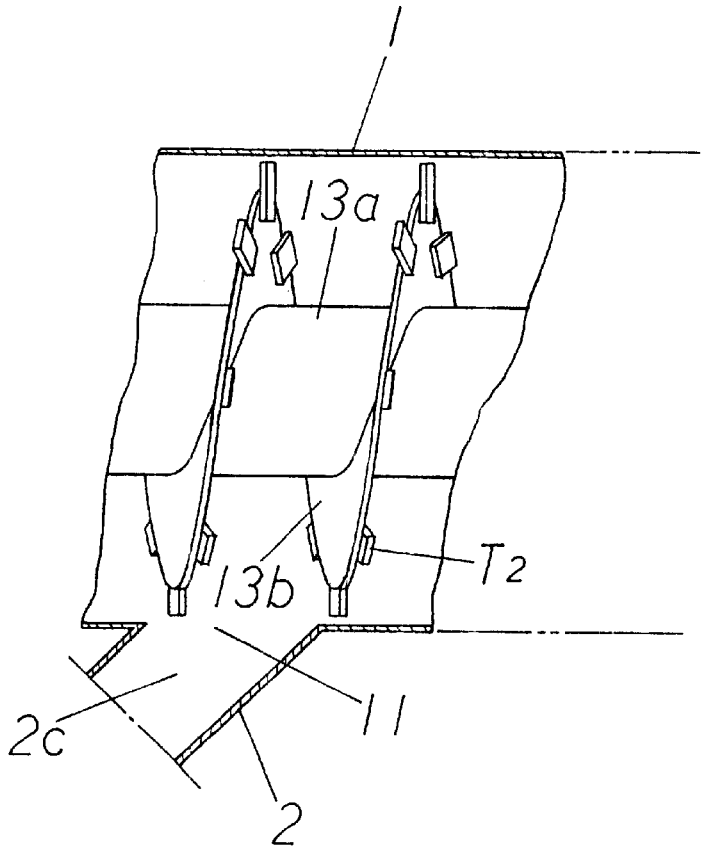
FIG. 6 is a schematic cross sectional view showing the pulp introduction port according to still another embodiment different from the embodiment in FIG. 4.
Figure 7:
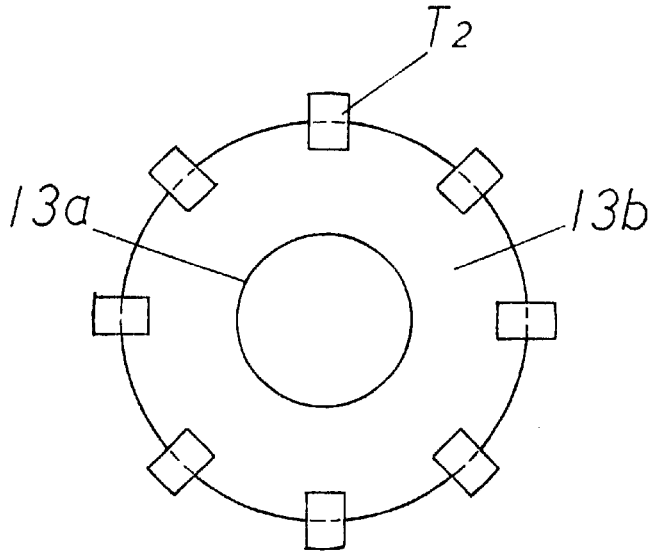
FIG. 7 is a schematic side view of FIG. 6.

The convex section $T_1$ can be formed by notching the outer periphery of the spiral vane section 13*b* as shown in FIGS. 4 and 5 for example. Moreover, the convex section $T_2$ is bound to the outer periphery of the spiral vane section 13*b* by welding as shown in FIGS. 6 and 7 for example.

According to the pulp heating apparatus of a first aspect, when pulp is supplied to the heater main body by the screw conveyor, since the forward end of the introduction passage provided with the screw conveyor therein faces towards the spiral vane section, the pulp can be broken by the spiral vane section. For this reason, a pulp breaking machine which is conventionally provided is not required between the screw conveyor and the disperser.

In addition, according to the pulp heating apparatus of a second aspect, in addition to the effect of the invention in the first aspect, the pulp exhausted from the screw conveyor can be further broken by the convex sections provided on the outer periphery of the spiral vane section facing towards the forward end of the introduction port.

What is claimed is:

1. A pulp heating apparatus comprising:

a heater main body having a pulp introduction port for introducing pulp, a vapor introduction port for introducing vapor, a disperser for dispersing the pulp introduced via the pulp introduction port under a high temperature and a pulp exhaust port for exhausting the pulp dispersed by the disperser, and said heater main body being arranged in horizontal direction, wherein said disperser has a spiral vane section which continues spirally around a rotational shaft and discontinuous vane sections around the rotational shaft, wherein said pulp introduction port is provided at a bottom section of said heater main body and is connected with an introduction passage and a screw conveyor is provided on the introduction passage, wherein a forward end of the introduction passage faces towards the spiral vane section.

2. A pulp heating apparatus comprising:

a heater main body having a pulp introduction port for introducing pulp, a vapor introduction port for introducing vapor, a disperser for dispersing the pulp introduced via the pulp introduction port under a high temperature and a pulp exhaust port for exhausting the pulp dispersed by the disperser, and said heater main body being arranged in horizontal direction, wherein said disperser has a spiral vane section which continues spirally around a rotational shaft and discontinuous vane sections around the rotational shaft, wherein said pulp introduction port is provided at a bottom section of said heater main body and is connected with an introduction passage and a screw conveyor is provided on the introduction passage, wherein a forward end of the introduction passage faces towards the spiral vane section, wherein convex sections are provided on an outer periphery of the spiral vane section facing towards the forward end of the introduction passage.

* * * * *